United States Patent [19]

Fietta et al.

[11] 4,187,793

[45] Feb. 12, 1980

[54] AUTOMATIC STITCH CUTTING DEVICE

[75] Inventors: Emilio Fietta, Milan; Giancarlo Della Torre, Biassono (Monza), both of Italy

[73] Assignee: Rockwell-Rimoldi, S.p.A., Milan, Italy

[21] Appl. No.: 929,380

[22] Filed: Jul. 31, 1978

[30] Foreign Application Priority Data

Sep. 22, 1977 [IT] Italy ..... 27829 A/77

[51] Int. Cl.[2] ..... D05B 65/06

[52] U.S. Cl. ..... 112/288; 112/301; 112/DIG. 1; 112/287

[58] Field of Search ..... 112/301, 288, 130, 286, 112/287, DIG. 1

[56] References Cited

U.S. PATENT DOCUMENTS

| | | | |
|---|---|---|---|
| 3,252,438 | 5/1966 | Firestein et al. | 112/288 |
| 3,712,256 | 1/1973 | Striegler et al. | 112/288 |
| 4,038,933 | 8/1977 | Marforio | 112/288 |

*Primary Examiner*—Werner H. Schroeder
*Assistant Examiner*—Andrew M. Falik

[57] ABSTRACT

A device for orienting a chain of stitches severed from a completed workpiece which includes a suction intake element for aligning the chain with the sewing axis, a clamping device for holding the chain in alignment with the sewing axis and a cutting means for severing that portion of the chain protruding from the clamping device so as to control the length of the chain to be incorporated into the initial stitches of a seam.

6 Claims, 3 Drawing Figures

AUTOMATIC STITCH CUTTING DEVICE

BACKGROUND OF THE INVENTION

The present invention pertains to an improved device for use on a sewing machine to automatically orient a chain of stitches and hold the same in a position forward of the presser foot so that said chain will be sewn into the seam to be formed on the next piece of material to be stitched.

As is well known, sewing machines that are adapted to form seams on a succession of pieces of material such for example as stitches of Classes 400, 500, 600, etc. according to the classification of the Federal Standard Catalog (U.S.A.), the stitches continue to be formed in the area between successive pieces of material, and means are provided for detaching said pieces one from the other by an automatic chain cutting device after the pieces have been caused to be advanced beyond the presser foot of the machine.

U.S. patent application Ser. No. 872,973 filed Jan. 27, 1978 now U.S. Pat. No. 4,149,478 discloses an automatic device for locating and holding a chain of stitches to be incorporated into the initial stitches of the seam to be formed on the next workpiece. This device includes an orienting element that serves to remove the cut chain from the cutting device and by means of a cooperating clamping and intake device the chain is then positioned and held in a plane which coincides substantially with the sewing axis and is in readiness for incorporation into the next seam to be formed. With the use of devices of this type, it has been possible to eliminate some of the disadvantages encountered with the devices noted above which, for example, include unsatisfactory insertion of the chain into the seam being formed, and the non-uniform thickness of the stitch in the initial portion of the new seam.

As is known, the chain of stitches is cut only if it is attached to a work piece which is caused to be advanced in front of the chain cutting device, because otherwise said chain assumes a position parallel to the cutting element itself of said device.

Therefore the length of the chain to be incorporated in a new seam depends on the amount of time which the machine requires to effectively stop after forming the last stitch on the sewn piece and the cutting of the chain from said piece.

Thus, lengths frequently result which are, excessively long, and thus the chain, being held only by the mechanical clamp that is located at a predetermined and fixed position spaced from the stitching instrumentalities of the machine, can be of a length which will interfere with the desired manner of its being incorporated into the seam.

The improved device according to the present invention provides a combined positioning, clamping and cutting apparatus that is effective, in addition to locating the chain, in cutting the same so as to selectively control the length which will be incorporated into a seam of stitches.

Additionally, the apparatus of the invention is movably mounted on a sewing machine so that there is no possibility of interference with the workpieces during their movement on the work surface of said machine.

SUMMARY OF THE INVENTION

In the apparatus of the invention, the positioning portion defines a suction intake device located adjacent to the clamping portion both of which are slidably mounted in a guide block that is assembled on a support arm which is pivotably attached to the framework of the sewing machine. This support arm also serves as a mounting for the cutting portion of the invention and is disposed in operative association with the suction intake device. This cutting portion is adapted to sever that part of the chain which protrudes from the clamp. With the cutting portion and suction intake device being mounted on the same support, a very definite advantage is provided whereby the severed excess part of the chain is automatically disposed of and that portion to be incorporated with a seam of stitches is of a predetermined length.

The ability to raise and lower the clamp and the suction intake device simultaneously also provides the required motion for actuating the cutter. The clamp and suction intake device are raised, relative to the plane of movement of the workpiece after each sewing cycle causing the chain to move beneath the clamp and the end thereof to enter said suction intake device. Prior to the start of the next seaming operation the clamp and suction intake are returned to their initial positions causing said clamp to grip the chain, the cutter to cut that portion of the chain protruding from said clamp, and the severed portion of the chain is disposed of by means of said suction intake. The gripping of the chain in this manner properly alligns it for incorporation into the seam of stitches that will be formed on the next workpiece.

Further characteristics and advantages of the present invention will become more fully apparent by reference to the appended claims and as the following detailed description proceeds in reference to the figures of drawing wherein:

DESCRIPTION OF THE PREFERRED EMBODIMENT

Figure 1:
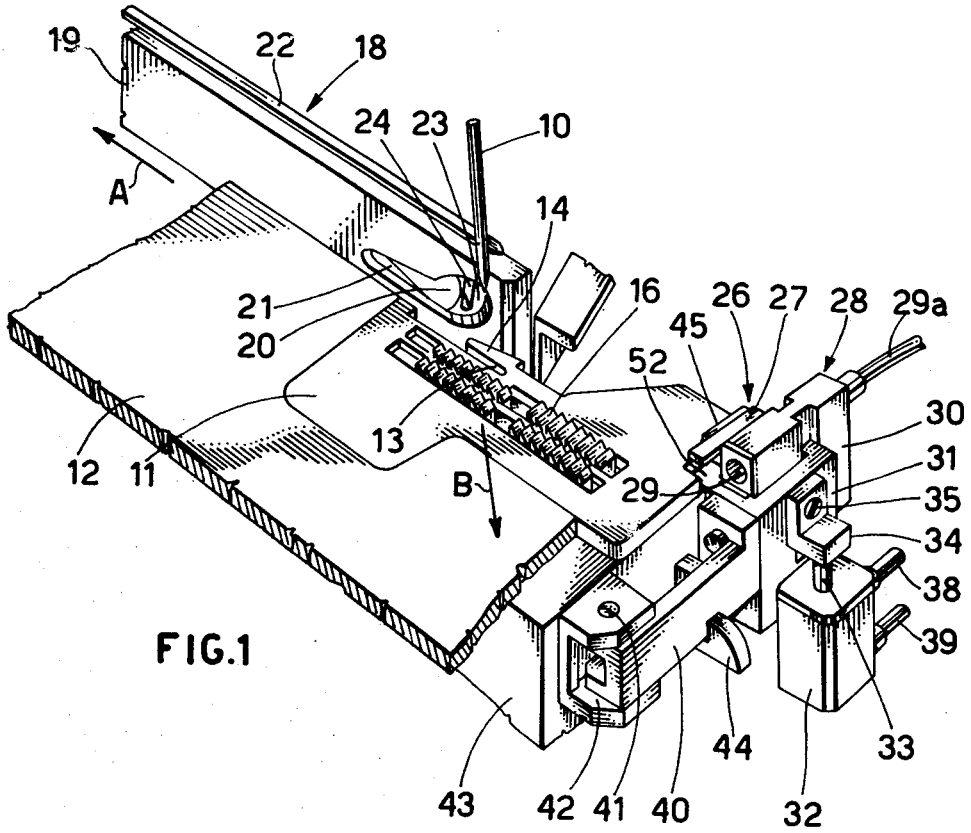
FIG. 1 is a perspective view of a portion of a sewing machine showing the device according to the invention applied thereto.

Referring now to FIG. 1, the device according to the invention for orienting a chain of stitches, cutting and holding it in position for incorporation into the initial stitches of a seam can be used, for example, on a sewing machine that is adapted to form stitches of type in Class 500 of the United States Federal Standard Catalog.

Figure 2:
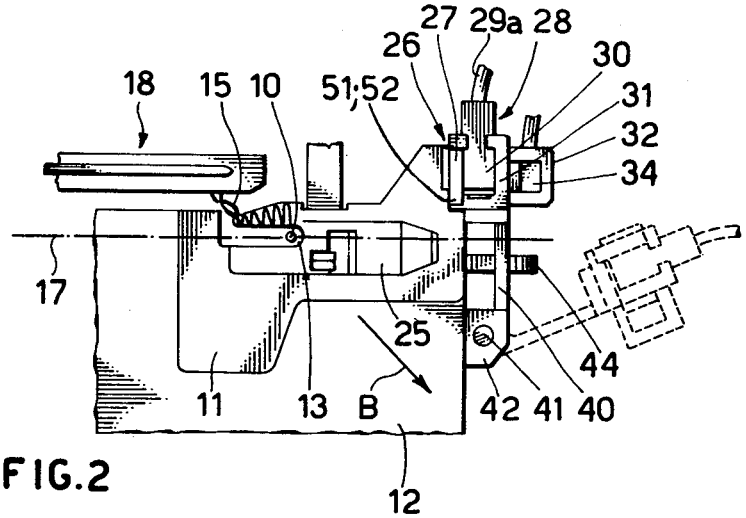
FIG. 2 is a top view of that portion of the machine and device shown in FIG. 1.

In FIGS. 1 and 2 only the sewing area of a sewing machine is shown which is sufficient to serve as a basis for a detailed description of the invention applied thereto. In these Figures of drawing a needle 10 shown which is located above a needle plate 11. This needle plate 11 is mounted in a worksurface 12 of the sewing machine and, as is well known, is adapted to support the material or so-called workpiece to be sewn.

The needle plate 11 is provided with a slotted opening 13 through which the needle 10 is caused to pass during the performance of its intended function of penetrating the material to be sewn and operatively cooperating with the stitching instrumentalities (not shown)

disposed beneath said needleplate. One side of the opening 13 defines a tongue 14 on which a chain of stitches 15 is formed as a result of continued sewing in the areas intermediate each successive workpiece.

The tongue 14 extends in the direction of the indicating arrow "A" in FIG. 1 which is the same direction as that which the workpieces are caused to advance during the sewing operation. The workpieces are advanced by a conventional form of feeddog 16 in a well-known manner and the combination of movements of the stitching instrumentalities and those of the feed mechanism defines a sewing axis 17 that extends parallel with the indicating arrow "A". The pieces of material and the seam formed on them are caused to advance along this axis 17.

Adjacent to the needle plate 11 and parallel to the sewing axis 17, a well-known type of automatic chain cutting device 18 is mounted that consists essentially of a suction tube 19 adjacent to the tongue 14. The suction tube 19 is provided with an opening 20 within which a blade 21 is assembled and which defines a chain cutter that is caused to function in a known manner. The chain 15 (FIG. 2) formed by a series of interlocked stitches on the tongue 14 is drawn into the suction tube 19 at the beginning and at the end of a seam formed on a piece of cloth and is cut by the blade 21. In the absence of a piece of cloth, these chains are caused to enter the tube, but are not cut, because they then assume a position parallel to the blade 21.

The chain cutter also includes a compressed air conduit 22 (FIG. 1) which terminates in an orienting element 23 located beyond the needle 10 and extending in that direction which the workpieces while being sewn are caused to travel. The orienting element 23 is provided with a nozzle 24 that is disposed above the needle plate and is oriented in such a way as to direct compressed air in the direction of the indicating arrow "B" toward the front of the machine which passes in close proximity with the needle 10 and intersects the axis 17.

A chain clamping device generally indicated by numberal 26 is attached to that portion of the machine's framework located forwardly of the needle 10 and said machine's presser foot which is depicted by numeral 25. This chain clamping device includes a spring biased and pivotably mounted blade member 27 that extends generally perpendicular to the axis 17 and serves to receive and grip the chain 15 in a manner to be more fully described hereinafter.

A suction intake element identified generally by numeral 28 (FIGS. 1 and 2) is located immediately adjacent to and extends parallel with the blade member 27 and includes a conduit 29 with the intake opening thereof being directed toward and spaced from the axis 17.

More precisely, the intake opening of the conduit 29 is spaced at a greater distance from the axis 17 than the end of the blade member and is effective in causing the chain to assume a position beneath said blade member when the end of the chain is caused to be drawn into the conduit through said intake opening.

The clamp device 26 and intake element 28 are mounted on a common slide block 30 which is vertically movable in a guide block 31 and provides a means during each sewing cycle of elevating these members so as to prevent interference with the workpieces as they advance along the worksurface 12.

Means for moving the slide block 30 is provided in order to have the clamp device 26 and intake element 28 located above the worksurface 12 (FIG. 1) during the clamping operation and to return them into alignment with the worksurface 12 upon completion of the clamping.

Figure 3:
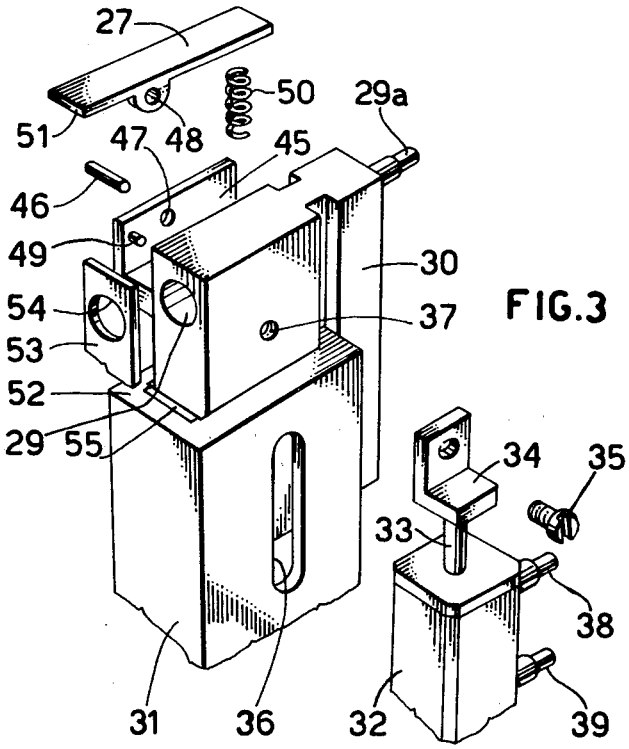
FIG. 3 is a perspective view in exploded form showing further detail of the device according to the invention.

The vertical displacement of the slide block 30 is effected by pneumatic means which includes a pneumatic cylinder 32 attached to the guide block 31 with the outer end of its actuating rod 33 operatively engaging the underside of a bracket member 34. This bracket member 34 is provided with a screw 35 which serves to attach it to the slide block 30 by passing through an elongated opening 36 in the guide block 31 and with the threaded portion thereof assembled in a threaded hole 37 (FIG. 3) provided in said slide block 30.

The pneumatic cylinder 32 is connected by means of two conduits 38 and 39 with a suitable pneumatic circuit (not shown) which controls its operation. The guide block 31 is supported in its operating position by means of a pivotable arm 40 which, is hinged on a pin 41 carried in a support bracket 42 that is attached to the frame 43 of the sewing machine. The guide block 31 is held against the frame 43 by a latch member 44 which engages the arm 40 intermediate its ends as shown, in FIGS. 1 and 2. With reference to FIG. 2, arm 40 and the elements mounted thereon are selectively moveable to the dotted line position shown in this Figure of drawing and provides a means for gaining access to the lower stitching instrumentalities of the machine.

As described above, the clamp device 26 and the intake element 28 are mounted on a single support or slide block 30 which is vertically disposed and which has the conduit 29 extending horizontally therethrough adjacent its upper surface. A suction or vacuum line 29A is attached to the conduit 29 with the opposite end of this vacuum line being connected to any suitable means (not shown) for drawing air into said conduit 29.

Adjacent to the conduit 29, the slide block 30 has an L-shaped bracket 45 fixed thereon which defines a channel within which the blade member 27 is pivotably supported on a pin 46. This pin passes through an opening 48 provided in an intergrally formed lug on the underside of blade member 27 and the ends of said pin assemble in aligned holes 47 (one only shown in FIG. 3).

The end of the blade member 27 adjacent the axis 17 is identified by Numeral 51 and is continually urged in the direction of the upper surface 52 of the guide block 31 by means of a coil spring 50. This spring is interposed between the lower surface of the L-shaped support bracket 45 and that end of the blade member 27 opposite its end 51. To provide clearance for the chain to enter beneath the end 51 when the clamp device is in its elevated position, a stop pin 49 is assembled in the side of the L-shaped bracket 45 so as to protrude into the channel formed thereby.

The end 51 of the blade 27 which is biased in the direction of the axis 17 protrudes beyond the slide block 30 so it will engage surface 52, when lowered to its gripping or operating positon. This surface 52 provides the fixed portion of the clamp device 26.

The intake element 28 is provided with a cutting member which is adapted to sever that portion of the chain 15 which protrudes from the clamp device 26. This cutting member defines a drilled plate element 53 disposed in contiguous relation with the intake opening of the conduit 29. The opening in the drilled plate element 53 defines a shear blade identified by numeral 54 and after reception of the chain therethrough and into the conduit 29 the slide block 30 is lowered causing operative cooperation between said opening and a blade 55 so as to sever that portion of the chain protruding from beneath the blade member 27.

In operating position, the drilled plate element 53 is located intermediate the slide block 30 and the blade 55 which is disposed within the guide block 31, in a manner whereby it is in alignment with the upper surface 52 thereof.

The upper edge of the opening 54 in the drilled plate element 53 extends above the position of blade member 27 to assure that the cutting of the chain is effected after said blade member has been caused to make contact with the upper surface 52 of the guide block 31.

Operation

During the formation of a seam, the workpiece is caused to advance beneath the presser foot 25 in the direction of the indicating arrow A by the feed dog 15, and during this movement the leading edge of the workpiece comes in contact with the needle 10 which initiates in a well-known manner formation of a seam that coincides with the axis 17.

Upon completion of a seam on a workpiece the trailing end of the latter approaches the opening 20 of the chain cutting device 18 and the chain of stitches formed between said trailing end and on the tongue 14 are drawn into said opening and severed so as to release the completed workpiece. The chain of stitches then formed until the machine stops continues to be drawn into the chain cutting device 18 and is caused to be oriented in a direction whereby it extends parallel to the blade 21.

Prior to the start of the next stitching cycle the presser foot 25 is elevated in a known manner for receiving another workpiece. The raising of the presser foot 25 interrupts the suction in the tube 19 and simultaneously causes a jet of air to be emitted from the nozzle 24. This jet of air effects removal of the free end of the chain from the cutting device 18 and temporarily directs it in the direction of the indicating arrow "B" (FIG. 2). In timed sequence with the emission of air from the nozzle 24 the cylinder 32 is activated to effect the raising of the slide block 30. The raising of the slide block 30 elevates the end 51 of the blade member 27 to a position above the upper surface 52 of the guide block 31 and uncovers the conduit 29 which immediately commences to draw air therein.

The air being drawn into the conduit 29 causes the free air of the chain to enter said conduit and that portion adjacent said free end to assume a position beneath the end 51 of the blade member 27.

After the free end of the chain enters the conduit 29 the slide block 30 is lowered by the reverse movement of the actuating rod 33 of the cylinder 32 which is effective in severing said free end and clamping that portion of the chain located beneath the blade member 27. The severed end of the chain is automatically disposed of with the flow of air through the conduit 29. As the next workpiece is caused to advance for the purpose of forming a seam therein its movement is effective in overcoming the gripping force of the clamp device 26 and the resistance provided by the latter is sufficient to produce a thickening effect of the inital stitches which assures incorporation of the chain into said seam in a desired manner.

I claim:

1. A device for controlling a chain of stitches when starting a seam in a sewing machine of the type having at least one stitch forming needle and feed mechanism defining the sewing axis and a needle plate with an integral tongue on which the chain of stitches is formed with a chain cutter mounted adjacent the needle plate for receiving the chain formed on the tongue, sad controlling device comprising:

(a) an orienting element (23) mounted on the machine for removing a chain of stitches severed from a workpiece from the chain cutter and extending the same in a generally forwardly direction, (b) a slide block (30) mounted on the machine forwardly of the feed mechanism with means for effecting vertical sliding movement thereof which includes:

(i) a suction intake element (28) for receiving the severed end of the chain positioned by said orienting element;

(ii) a clamping device (26) for receiving and gripping the chain adjacent said suction intake element; and (iii) a cutting means (54–55) operatively associated with said suction intake element for severing that portion of the chain extending from the latter to said clamping device.

2. The apparatus according to claim 1 wherein said device includes a guide block (31) pivotably attached to the machine for slidably supporting said slide block (30).

3. The apparatus according to claim 2 wherein said means for effecting vertical sliding movement of said slide block (30) defines a pneumatic cylinder (32).

4. The apparatus according to claim 2 wherein said clamping device define a blade member (27) pivotably mounted on the side of said slide block (30) and biasing means for continually urging one end of said blade member toward the upper support (52) of said guide block (31).

5. The apparatus according to claim 2 wherein said cutting means includes a fixed blade (55) assembled in said guide block (31) and a plate element (53) mounted on said slide block (30) having an opening aligned with said suction intake element (28) for receiving a chain therethrough defining a shear blade (54) movable with said slide block to and from operative association with said fixed blade.

6. The apparatus according to claim 1 wherein said suction intake element (28) defines a conduit (29) horizontally disposed within the upper portion of said slide block (30).

* * * * *